US005946757A

United States Patent [19]

Oliveira

[11] Patent Number: 5,946,757

[45] Date of Patent: Sep. 7, 1999

[54] 360° THREAD CLEANER

[76] Inventor: Paul L Oliveira, P.O. Box 507, Volcano, Hi. 96785

[21] Appl. No.: 09/035,808

[22] Filed: Mar. 6, 1998

Related U.S. Application Data

[60] Provisional application No. 60/040,219, Mar. 6, 1997.

[51] Int. Cl.[6] ..... B08B 9/02

[52] U.S. Cl. ..... 15/104.04; 15/88

[58] Field of Search ..... 15/88, 104.03, 15/104.04

[56] References Cited

U.S. PATENT DOCUMENTS

| | | | |
|---|---|---|---|
| 1,600,927 | 9/1926 | Bryant | 15/104.04 |
| 3,188,674 | 6/1965 | Hobbs | 15/104.04 |
| 4,014,062 | 3/1977 | Scott et al. | 15/88 |
| 4,262,410 | 4/1981 | Roberts | 15/104.04 |
| 4,433,448 | 2/1984 | True | 15/104.04 |
| 5,168,660 | 12/1992 | Smith | 15/104.04 |

*Primary Examiner*—Terrence R. Till
*Attorney, Agent, or Firm*—Patent & Trademark Services; Joseph H. McGlynn

[57] ABSTRACT

A 360° screw thread cleaner which is a hand operated tool for cleaning the spiral grooves of threads on the exterior of a pipe. It has sliding jaws, which have cleaning bristles, and the jaws adjust simultaneously when a scroll section is rotated either clockwise or counterclockwise for smaller or larger diameter pipes.

9 Claims, 3 Drawing Sheets

360° THREAD CLEANER

This is a conversion of Provisional application Ser. No. 60/040,219, filed Mar. 6, 1997.

BACKGROUND OF THE INVENTION

This invention relates, in general, to, a screw thread cleaner and in particular to a screw thread cleaner that, when rotated, cleans the complete circumference of the screw threads, has sliding jaws that can be adjusted to fit different diameter threads.

DESCRIPTION OF THE PRIOR ART

In the prior art various types of pipe thread cleaners have been proposed. Conventional brushes have been used for cleaning screw threads, however they must be maneuvered, while stroking back and forth, around the circumference of a given thread in an attempt to reach all the surfaces of a spirally grooved thread. Such an operation is prone to result in an undesirable outcome because of the relatively small contact area between the round thread and the straight line of the bristles on a brush. Also, because cleaning screw threads with a conventional brush can be laborious and tedious, this task is often done haphazardly or not at all. Also, with the proliferation of chemical products used for the purposes of locking, sealing, mounting, and retaining threaded fastening assemblies, the thread surfaces to which these products are applied must be cleaned by removing dirt, grease, oil, rust, and even previous applications of these chemicals.

The present invention overcomes the above mentioned disadvantages and provides a screw thread cleaner that has within its inherent design, and consequently within it's very operation, the ability to easily, quickly and safely clean screw threads regardless of which manufacturing standard or configuration was used to form threads.

SUMMARY OF THE INVENTION

The present invention is directed to a 360° screw thread cleaner which is a hand operated tool for cleaning the spiral grooves of threads on the exterior of a pipe. It has sliding jaws, which have cleaning bristles, and the jaws adjust simultaneously when a scroll section is rotated either clockwise or counterclockwise for smaller or larger diameter pipes.

It is an object of the present invention to provide a screw thread cleaner that can clean helical thread in a 360° manner.

It is an object of the present invention to provide a screw thread cleaner that can be adjusted to fit the diameter of a different size threads.

It is an object of the present invention to provide a screw thread cleaner that safely and easily, will improve the thread cleaning operation.

These and other objects and advantages of the present invention will be fully apparent from the following description, when taken in connection with the annexed drawings.

DESCRIPTION OF THE PREFERRED EMBODIMENT

Figure 1:
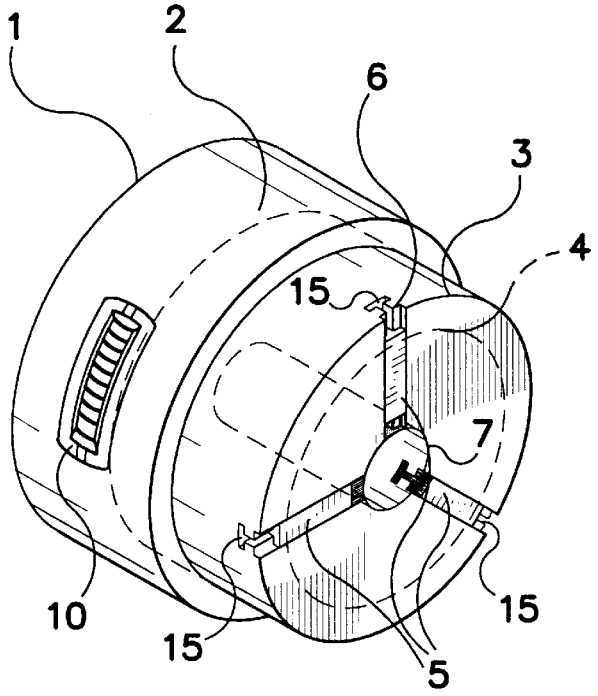
FIG. 1 is a perspective view of the present invention.
Figure 2:
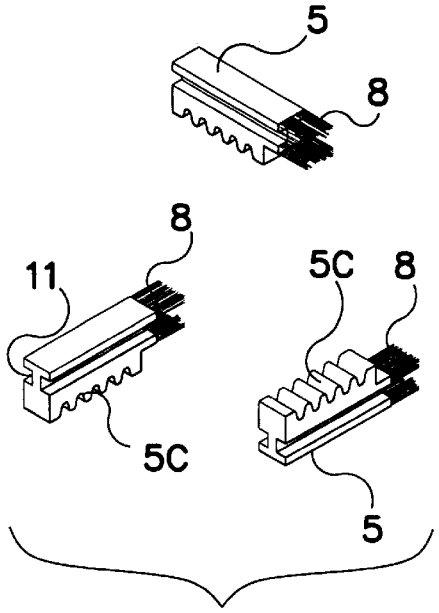
FIG. 2 is a perspective view of the sliding jaws of the thread cleaner of the present invention.
Figure 5:
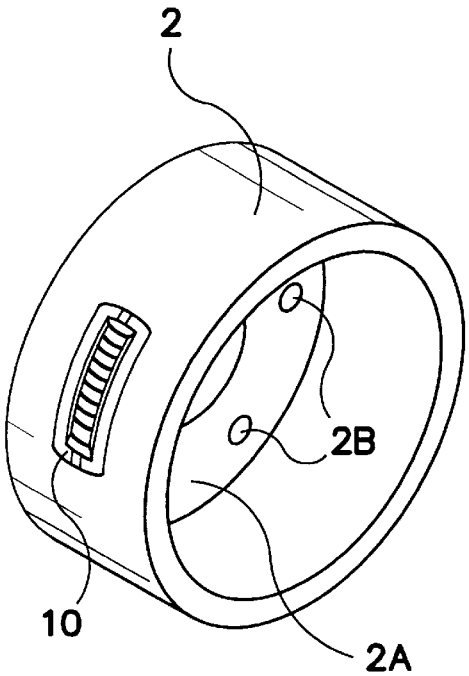
FIG. 5 is a perspective view of the front of the coupling/controller or outer housing of the present invention showing the brake and the compression lip section.
Figure 6:
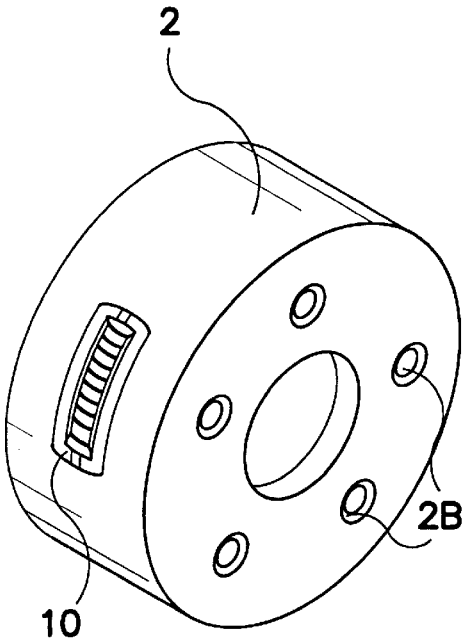
FIG. 6 is a perspective view of the back of the coupling/controller or outer housing of the present invention.

Referring now to the drawings in greater detail, FIG. 1 shows the thread cleaner 1 of the present invention, having an outer housing 2, inner housing unit 3, sliding jaws 5, center hole 7 on the inner housing 3, and brake 10 in the outer housing 2. As shown in FIGS. 5, 6, the outer housing has a back wall 2A with a plurality of apertures 2B therethrough for a purpose to be described below.

Figure 3:
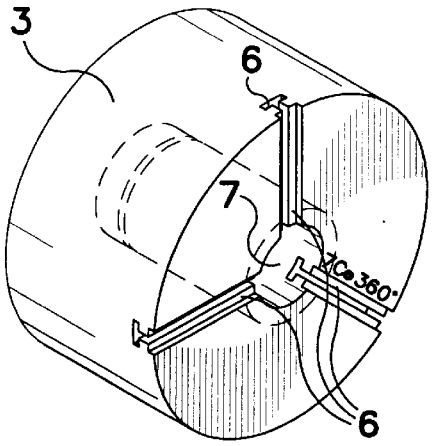
FIG. 3 is a perspective view of the front of the inner housing unit of the present invention.
Figure 4:
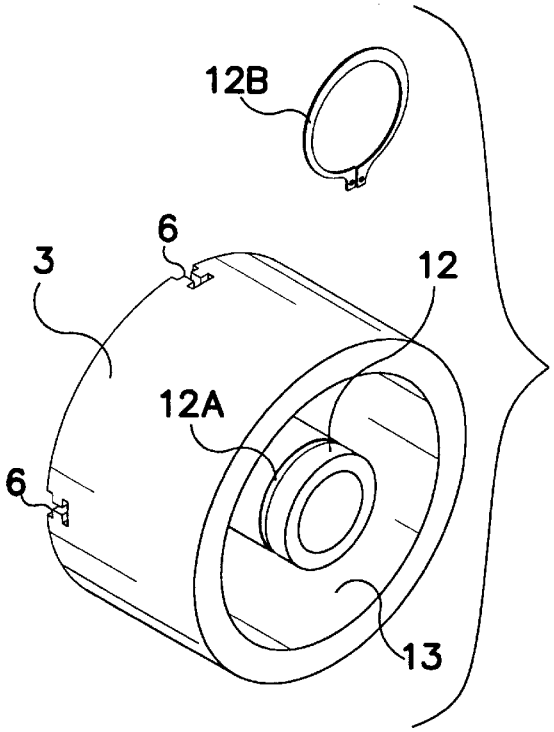
FIG. 4 is a perspective view of the back of the inner housing unit of the present invention showing the support section, the retaining ring groove, the external retaining ring, and the scroll cage area.

Inner housing member 3, as shown in FIGS. 3 and 4, has a plurality of T-shaped slots 6 extending radially from a center aperture 7. The sliding jaws 5, have a corresponding T-shaped section 11 so the jaws will slide in the slots 6. Each jaw 5 has a plurality of stiff bristles 8 on one end which will engage the threads in order to clean them. Although bristles are shown on the ends of the jaws, it should be noted that other types of structures can be used to engage and clean the threads without departing from the scope of the invention.

Figure 7:
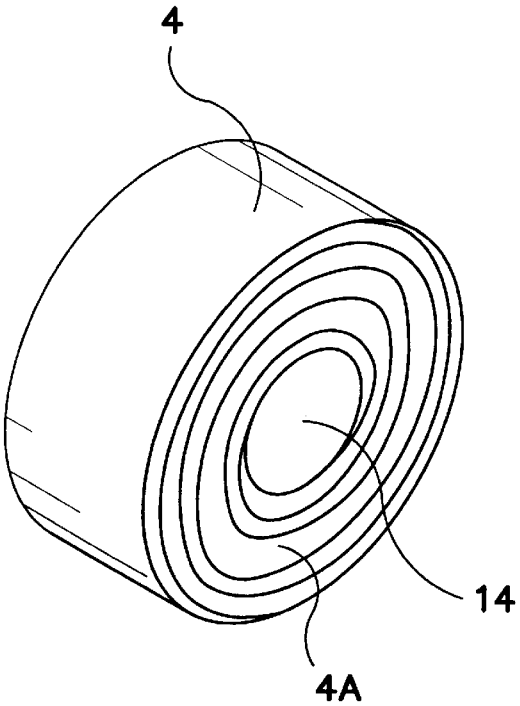
FIG. 7 is a perspective view of the front of the spiral jaw controller of the present invention showing the grooved scroll section and the center opening.

Each jaw 5 also has a series of teeth 5A opposite the T-shaped section 11 which will engage with the edge of the spiral portion 4 (see FIGS. 7 and 9) and will allow the jaws to move toward and away from the center aperture 7. This movement will allow the pipe thread cleaner to adjust to different diameter pipes.

As shown in FIG. 4, the inner housing 3 has a center hub 12 with a central aperture 21 extending therethrough and communicating with aperture 7. Hub 12 is spaced from the inner wall of housing 3 to form a space 13 for the spiral 4, and has a groove 12A at one end to receive a resilient snap ring clip 12B which will hold spiral 4 on the hub 12.

Figure 8:
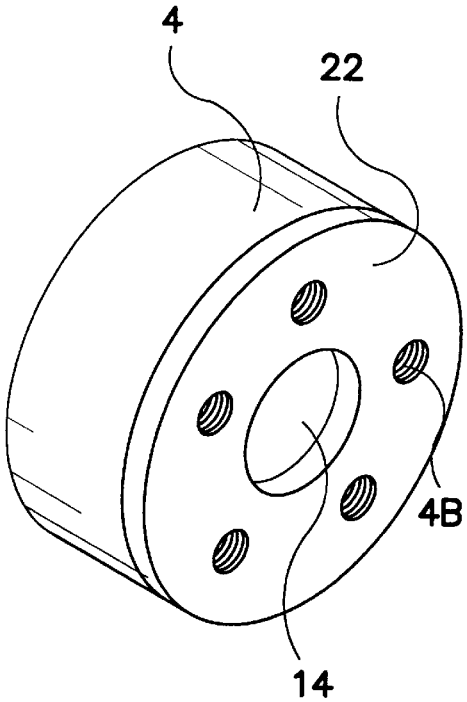
FIG. 8 is a perspective view of the back of the spiral jaw controller of the present invention showing the attachment holes and the center opening.
Figure 9:
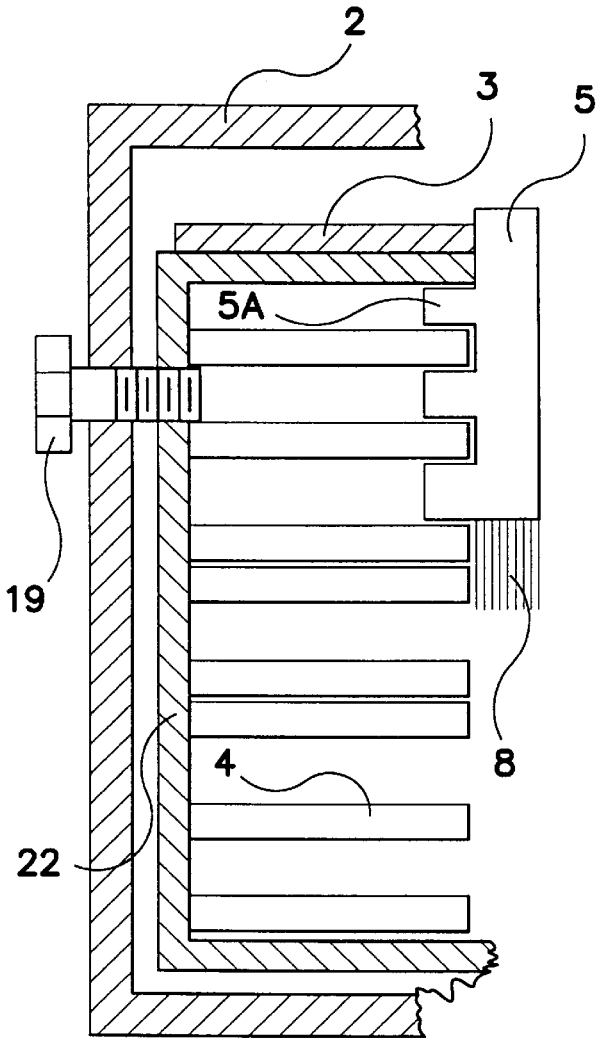
FIG. 9 is a partial section view of the outer and inner housings, the spiral jaw controller and the sliding jaws of the present invention.

As shown in FIG. 8, the spiral 4 has a back plate 22 which is attached, by any conventional means, to the outer spiral 4A. The back plate 22 has a plurality of threaded apertures 4B therethrough which correspond to the apertures 2B in the outer housing 2. A plurality of bolts (only one of which is shown in FIG. 9) will pass through apertures 2B and thread into apertures 4B in order to secure the outer spiral 4A to the outer housing 2. The inner most spiral 4C is secured to the hub 12 so that when the outer housing 2 is rotated, with respect to the inner housing 3, the spiral will expand or contract, depending on which way the housings are turned relative to each other.

Since the jaws are secured to the spiral, by means of the teeth 5A engaging the edges of the spiral 4 (as shown in FIG.

9), the jaws 5 will slide toward and away from the center aperture 7 as the spiral expands or contracts. This will allow the thread cleaner to be adjusted for different diameters of pipe.

Figure 10:
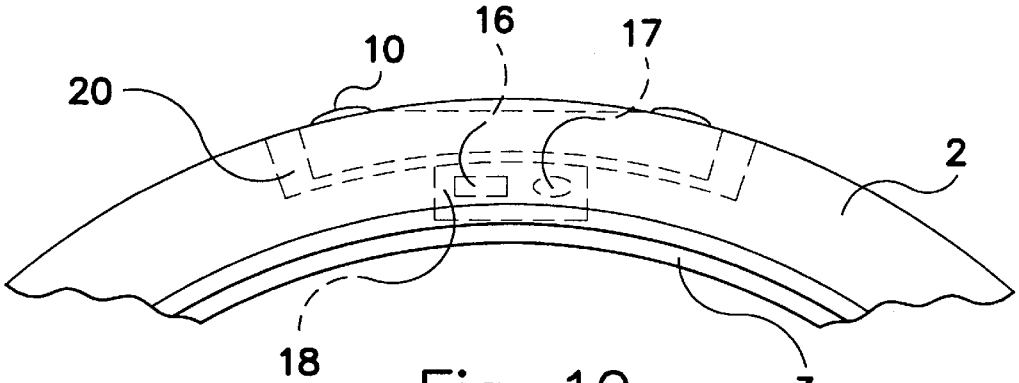
FIG. 10 is a partial view of the brake mechanism of the present invention.

In order to hold the housings 2, 3 in a fixed position, once they have been adjusted for a specific pipe, a brake mechanism 10 is used (see FIGS. 1 and 10). The brake 10 has a pin 17 secured thereto, which rides in a angled slot 16 in the wall of housing 2. The brake has a end 18 which will engage the outer surface of housing 3. In order to use the brake, the housings 2, 3 are rotated until the jaws are in the proper position (depending on the size of the pipe to be cleaned, then the user would push the brake 10 down the inclined groove 16 until the end 18 engages the outer surface of the housing 3. The friction between the pin, the slot and the end of the brake engaging the outer surface of housing 3 will prevent the housings 2, 3 from moving out of position.

Figure 11:
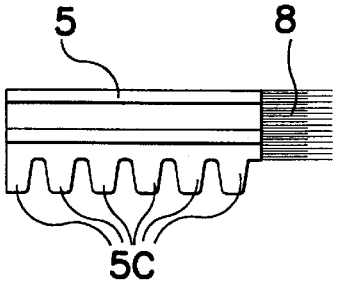
FIGS. 11–13 show side views of three of the sliding jaws.
Figure 12:
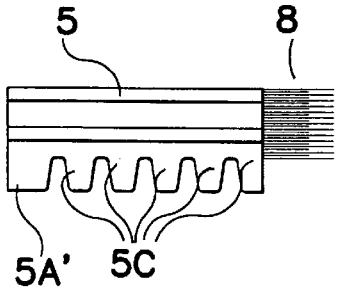
Figure 13:
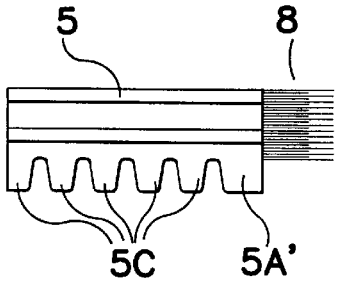

As shown in FIGS. 11–13, each of the sliding jaws have a different configuration of teeth 5A. In FIG. 11, the end teeth 5C are substantially the same size, in FIG. 12, the end tooth 5A' on the left side is larger than the end tooth on the right side, and in FIG. 13, the end tooth 5A' on the right side is larger than the and tooth on the left side.

In use, a user would place a pipe with threads into aperture 7, and then rotate inner housing 3 with respect to outer housing 2 until the ends 8 of jaws 5 engage the threads. Then the user would push brake 10 until the inner and outer housings are fixed in position. Then by rotating the device back and forth, or 360° around the pipe, the pipe threads would be easily and efficiently cleaned.

Although the pipe thread cleaner and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A device for cleaning screw threads on a threaded member comprising:

an inner housing and an outer housing, said inner housing being telescopically received with said outer housing, said inner housing is rotatably movable with respect to said outer housing, a central aperture within said inner housing, and said inner housing also having radial slots, each of which communicate with said central aperture, a plurality of cleaning means for cleaning screw threads on a threaded member, said cleaning means being slidably mounted within said radial slots, operator means for moving said cleaning means toward and away from said central aperture, brake means for holding said cleaning means in a selected position with respect to said radial slots.

2. The device for cleaning screw threads as claimed in claim 1, wherein said radial slots have a T-shape cross-section, and each said cleaning means have a complimentary T-shaped section which engages in said T-shape cross-section of each of said radial slots.

3. The device for cleaning screw threads as claimed in claim 1, wherein each said cleaning means has a plurality of bristles on one end, said bristles being adjacent said central aperture.

4. The device for cleaning screw threads as claimed in claim 1, wherein said operator means is a spiral with a plurality of turns, and one end of which is attached to a portion of said inner housing and another end of which is attached to a portion of said outer housing.

5. The device for cleaning screw threads as claimed in claim 4, wherein each of said cleaning means have a plurality of teeth disposed thereon, said teeth engage said plurality of turns on said spiral.

6. The device for cleaning screw threads as claimed in claim 5, wherein there are three cleaning means, two of said cleaning means have at least one tooth, of said plurality of teeth, which is a different size than the remaining teeth on each of said two cleaning means.

7. The device for cleaning screw threads as claimed in claim 1, wherein said brake means comprises a first portion which extends through an outer wall in said outer housing, and a second portion which engages an outer wall of said inner housing.

8. The device for cleaning screw threads as claimed in claim 7, wherein said brake means has a projection which engages a slot in a wall of said outer housing.

9. The device for cleaning screw threads as claimed in claim 8, wherein said slot is a slanted slot.

* * * * *